US007313882B2

(12) United States Patent
Beretta

(10) Patent No.: US 7,313,882 B2
(45) Date of Patent: Jan. 1, 2008

(54) HOLD ADJUSTMENT DEVICE BETWEEN FORE-END IRON AND ACTION BODY IN A BREAK-OPEN FIREARM

(75) Inventor: Ugo Gussalli Beretta, Gardone Val Trompia (IT)

(73) Assignee: Fabbrica D'Armi Pietro Beretta S.p.A., Gardone Val Trompis, Brescia (IT)

( * ) Notice: Subject to any disclaimer, the term of this patent is extended or adjusted under 35 U.S.C. 154(b) by 29 days.

(21) Appl. No.: 11/238,185

(22) Filed: Sep. 28, 2005

(65) Prior Publication Data

US 2006/0070289 A1 Apr. 6, 2006

(30) Foreign Application Priority Data

Oct. 6, 2004 (IT) ..... MI2004A1892

(51) Int. Cl.
*F41A 3/00* (2006.01)

(52) U.S. Cl. ..... 42/40; 42/44; 42/45
(58) Field of Classification Search ..... 42/2–50, 42/75.04
See application file for complete search history.

(56) References Cited

U.S. PATENT DOCUMENTS

2003/0089015 A1* 5/2003 Beretta ..... 42/40

FOREIGN PATENT DOCUMENTS

EP 0 862 040 A 9/1998

OTHER PUBLICATIONS

International Search Report, Dec. 9, 2005.

* cited by examiner

*Primary Examiner*—Teri Pham Luu
*Assistant Examiner*—John Davis Holman
(74) *Attorney, Agent, or Firm*—Hedman & Costigan P.C.; James V. Costigan

(57) ABSTRACT

A hold adjustment device between fore-end iron and action body in a break-open firearm comprising at least one barrel (13) mobile by rotation about a fixed hinging point (15) arranged on an action body (14) between an aligned closed position and a disengaged position rotated open with respect to the action body (14), a tenon (18) fixed at the bottom to the at least one barrel (13) for hooking with a fore-end iron (16), comprising a block (21), or cursor, axially mobile with respect to the fore-end iron (16) and suitable for interfering with the tenon (18), an adjustment pin (26) carrying on its stem-shaped portion (27) a plurality of ring-shaped springs (28), as well as a rear axial binding (30), in which the elastic adjustment device of the fore-end iron-action body hold (20) is suitable for giving a suitable hold and/or the recovery of the loss of hold due to the wear of the fore-end iron-action body coupling.

7 Claims, 3 Drawing Sheets

HOLD ADJUSTMENT DEVICE BETWEEN FORE-END IRON AND ACTION BODY IN A BREAK-OPEN FIREARM

The present invention refers to a hold adjustment device between fore-end iron and action body in a break-open firearm.

It is known that in so-called break-open firearms, for example in a firearm 10 shown in FIG. 1 relating to the prior art, the opening of the firearm is carried out through an opening key 12 by rotation of a barrel 13, or of the barrels, with respect to a receiver plane 14, or action body, about a fixed hinging point 15. It is particularly important to have an adequate hold between the barrel group 13 and the action body 14, since, by carrying out a counteraction force in the contact between an fore-end iron 16, housed in a fore-end 17 and the action body 14, a friction is generated that is able to create a condition of equilibrium of the barrels 13 when opening, which would otherwise be unbalanced by their own weight and would thus fall freely downwards.

In FIG. 1 a break-open firearm is shown in closed position in which, according to the prior art, in the act of assembly, a manual adjustment is carried out on a tenon 18 of one or more barrels 13, so as to obtain a forcing of the fore-end iron 16. Such forcing gives the firearm 10 the characteristic rotation that is stiff or with a certain resistance of the barrels 13.

However, a substantial drawback of such a known solution consists of the fact that the slightest variation in the adjustment of the height of the tenon 18, carried out manually, given the great rigidity of the fore-end iron element 16, generates a great variation in the fore-end iron-action body contact force. Such a variation can create extremely variable conditions of friction, and thus of operation, in every firearm.

Finally, it should not be forgotten that, given the criticality of the degree of forcing, a slight variation thereof, through normal working wear, can make it deteriorate too early from the ideal operating conditions. In practice, there is already a loss of the initial hold after the firearm has been opened-closed a few hundred times.

The purpose of the present invention is that of making a hold adjustment device between fore-end iron and action body in a break-open firearm that allows the fore-end iron-action body hold to last a long time, reducing sensitivity to wear.

Another purpose of the present invention is that of making a hold adjustment device between fore-end iron and action body in a break-open firearm that allows the clearances due to the sum of the tolerances of the individual elements to be recovered and thus allows a constant opening and closing force of the firearm to be obtained in production without the need for manual adjustments on the tenon.

Another purpose of the present invention is that of making a hold adjustment device between fore-end iron and action body in a break-open firearm that allows the user the possibility of adjusting the opening and closing force of the firearm as desired.

Moreover, another purpose of the present invention is that of allowing the above conditions to be created in a small space, not modifying the shape and size of the fore-end iron and of the fore-end, a thing that is very important in a break-open firearm where aesthetics and ergonomics are of great importance.

Also a purpose of the present invention is to use alternative materials, such as light alloys, in favour of a saving in weight and processing costs.

Another purpose of the present invention is that of making a hold adjustment device between fore-end iron and action body in a break-open firearm that is particularly simple and functional, with low costs.

These purposes according to the present invention are accomplished by making a hold adjustment device between fore-end iron and action body in a break-open firearm as outlined in claim 1.

Further characteristics are foreseen in the dependent claims.

The characteristics and advantages of a hold adjustment device between fore-end iron and action body in a break-open firearm according to the present invention shall become clearer from the following description, given as a non-limiting example, referring to the attached schematic drawings, in which.

Figure 1:
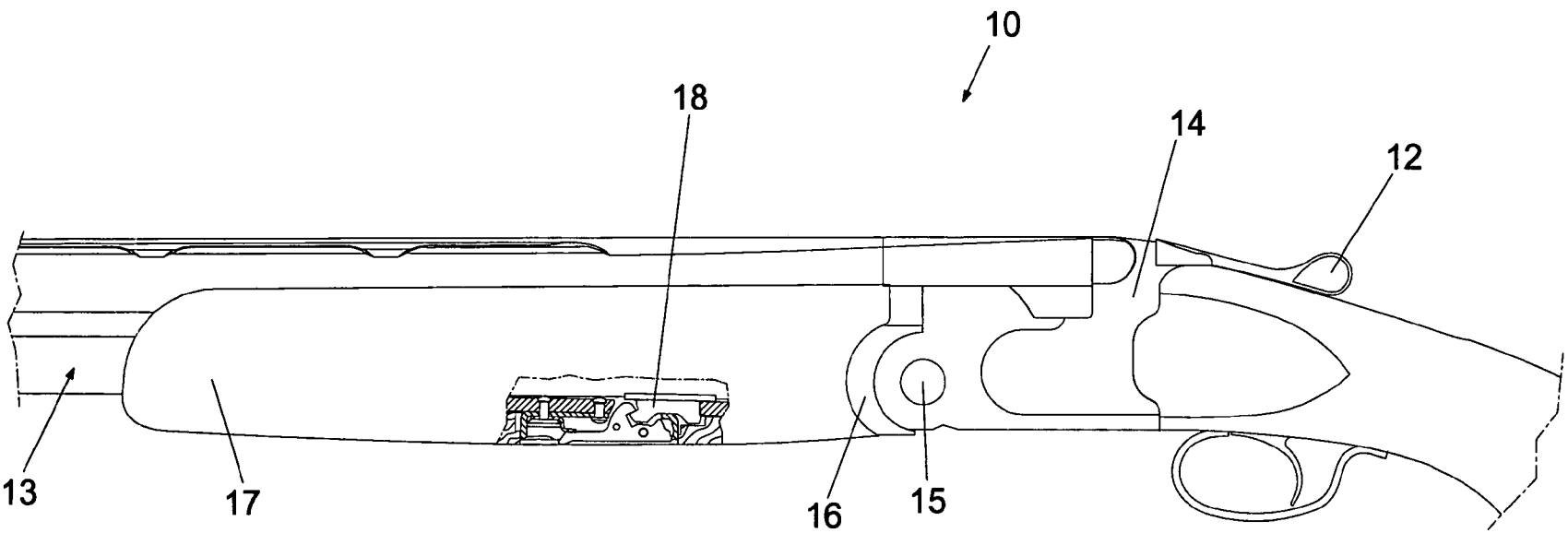
Fig. 1 PRIOR ART
FIG. 1 is a side elevation view, partially in section, of a central part of a break-open firearm according to the prior art, in closed position, with forcing of the tenon on the fore-end iron.

With reference to FIGS. 2 to 5, in the present description, for the same elements described relative to the prior art we shall use the same reference numerals shown in FIG. 1, which shows a known break-open firearm 10 already manufactured by the Applicant, in which opening is carried out through the opening keys 12 by rotation of a barrel 13, or of the barrels, possibly equipped with aiming members with respect to the receiver plane 14, or action body, about the fixed hinging point 15.

A hold adjustment device 20 of the break-open firearm 10 according to the present invention is mounted in the fore-end 17 and in particular according to a preferred embodiment is integrated in the structure of the fore-end iron 16. The adjustment device 20 comprises a block 21, or cursor, provided on opposite side surfaces with guides 22 for the axially sliding attachment in an opening, or window 23, of the fore-end iron 16.

At a first end the cursor 21 is equipped with an inclined plane 24 for the forced contact with the tenon 18 that is firmly fixed to the barrel, not shown. At the opposite end the cursor 21 comprises a seat 25 that receives an end portion of an adjustment pin 26, i.e. of a stem 27 thereof that axially supports a plurality of ring-shaped springs 28.

The clearance between the bottom of the seat 25 and the stem 27 allows a determined work stroke of the adjustment device 20 at the same time making a mechanical stop for the stem 27 so as not to bias the springs 28 in a pack.

At the opposite end the pin is equipped with a threaded shank 29 for the connection to a rear axial constraint, in the example made through a rear support 30 that is stably associated with the fore-end iron 16 in the axial direction.

In a central portion the adjustment pin 26 comprises a collar 31 on which the pack of springs 28 abuts and that is provided with one or more holes 32, or elements for the adjustment of the preload acting on them.

As shown in the figures, the pack of springs 28, at the opposite end, is in abutment on the cursor 21.

The rear support 30, according to a preferred embodiment shown as a non-limiting example in the figures, is a substantially cylindrical element, with a top portion having a greater diameter, suitable for being arranged in a seat 33 of a shape matching the fore-end iron 16. The rear support 30 comprises a threaded axial hole 34 that receives the threaded shank 29 of the adjustment pin 26.

The ring-shaped springs 28, available on the market, comprise a plurality of outer rings and a plurality of inner rings alternating with each other. The rings are equipped with a flat side with cylindrical generatrix respectively facing towards the outside or the inside and an opposite side comprising two inclined planes, so as to form a V-shaped cross section.

The rings 28 are arranged in a pack so that the inclined planes of every ring 28, inner or outer, face an inclined plane of two opposite contiguous rings 28.

Figure 2:
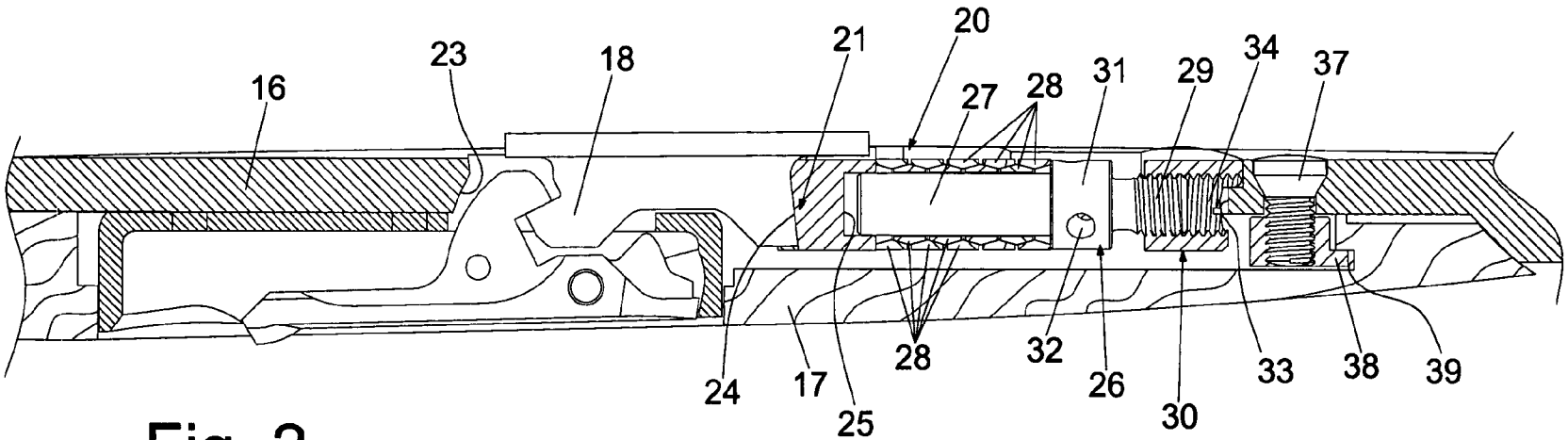
FIG. 2 is a side elevation view, partially in section, of a central part of a break-open firearm in closed position with a hold adjustment device according to the present invention.
Figure 3:
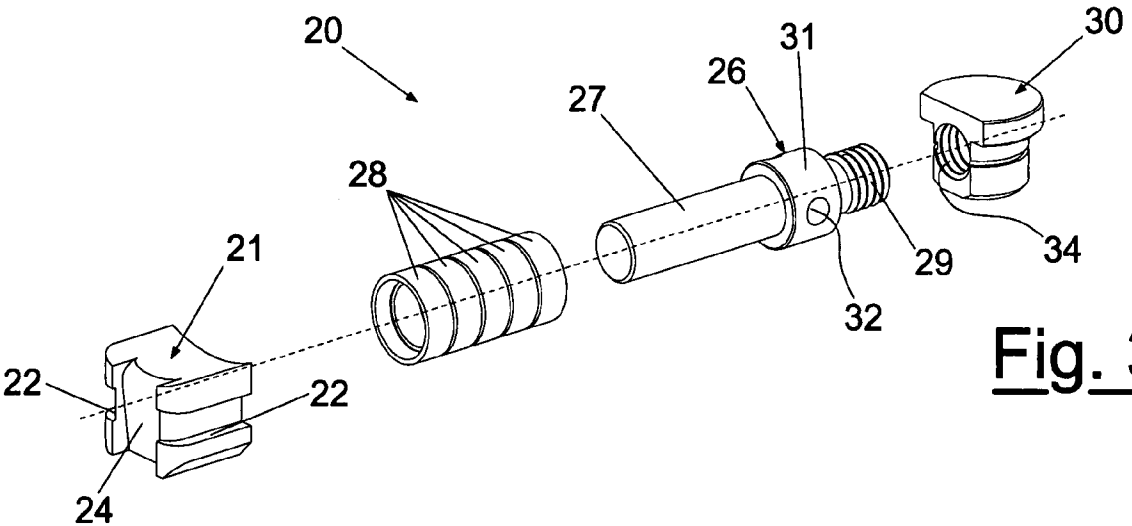
FIG. 3 shows the hold adjustment device exploded.
Figure 4:
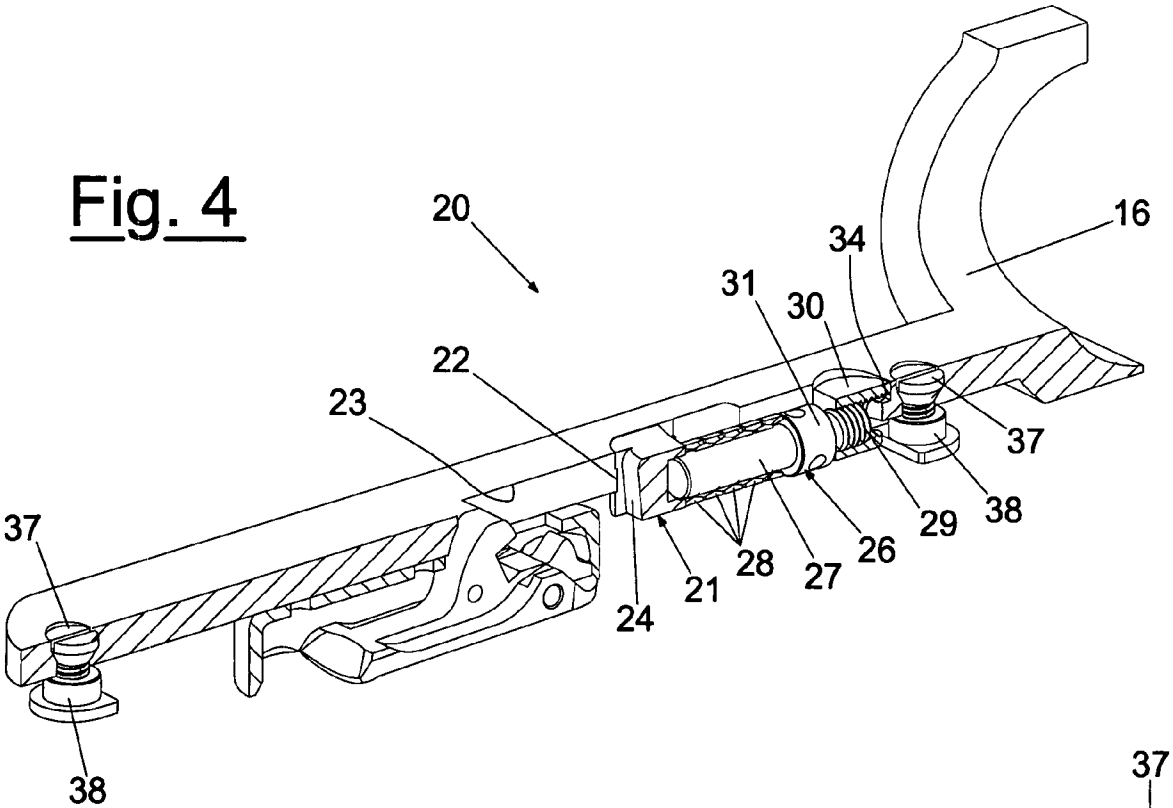
FIG. 4 is an axonometric view of the fore-end iron, partially sectioned, carrying a hold adjustment device sectioned.
Figure 5:
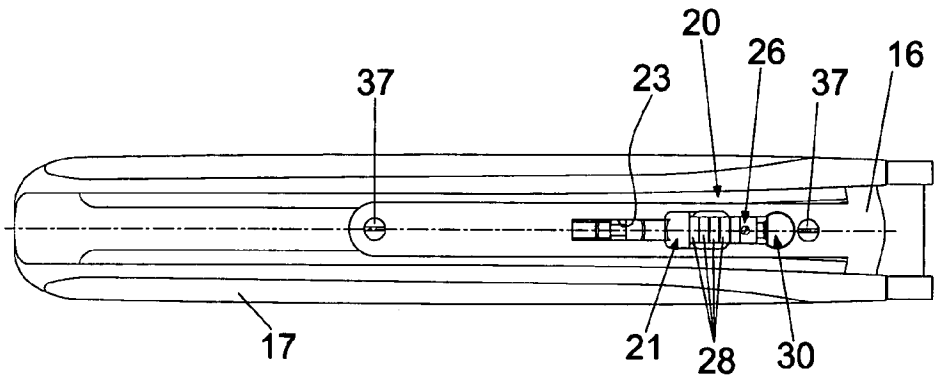
FIG. 5 is a plan view of a fore-end carrying a hold adjustment device of a break-open firearm according to the present invention.

In the embodiment shown in the detail of FIG. 2 the fore-end iron 16 is stably connected to the fore-end 17 through two screws 37, arranged at the end of the fore-end iron 16 and connected to shaped small blocks 38 to engage in matching recesses 39 of the fore-end 17.

Under the thrust of the tenon 18, the cursor 21, axially mobile with respect to the fore-end iron 16, compresses the series of ring-shaped springs 28 supported by the stem 27 of the adjustment pin 26.

The rear support 30, axially attached to the fore-end iron 16, transfers the force of the springs 28 in the fore-end iron-action body contact ensuring the holding force.

The use of ring-shaped springs 28 of the type described keeps a high force in a working stroke that allows the recovery of the processing tolerances and of the clearances due to wear.

With the rotation of the pin 26, through a suitable tool to be inserted in the holes 32, an axial displacement thereof is generated with respect to the rear support 30, the two elements being firmly connected by a thread. Thus through the contact of the collar 31 of the pin 26 with the ring-shaped springs 28 it is possible to adjust the preload thereof.

It is clear that a hold adjustment device according to the invention can be mounted on a firearm with break-open barrel(s), i.e. in which the opening of the firearm is carried out by rotation of the barrel (or of the barrels) with respect to the receiver plane, or action body, without limitations as regards the type of firearm that can be of the sporting type (for example an over-and-under, side-by-side or single-barrelled rifle, in this case also with semi-automatic operation), with a smooth or rifled bore.

The hold adjustment device between fore-end iron and action body in a break-open firearm, object of the present invention, has the advantage of recovering the predictable loss of hold due to the greater wear of the contact between fore-end iron made from light alloy and the action body made from steel.

Moreover, the ring-shaped springs advantageously provide a high force in extremely low bulks, which can be integrated in the spaces already available in known firearms.

Moreover, the adjustment device according to the invention advantageously accomplishes all of its purposes.

A hold adjustment device between fore-end iron and action body in a break-open firearm conceived according to the present invention can undergo numerous modifications and variations, all of which are covered by the same invention.

Moreover, in practice, the materials used, as well as their sizes and the components, can be whatever according to the technical requirements.

The invention claimed is:

1. A hold adjustment device between fore-end iron and action body in a break-open firearm comprising at least one barrel (13) mobile by rotation about a fixed hinging point (15) arranged on an action body (14) between an aligned closed position and a disengaged position rotated open with respect to said action body (14), a tenon (18) fixed at the bottom to said at least one barrel (13) for hooking with a fore-end iron (16), characterized in that it comprises a block or cursor (21) axially mobile with respect to said fore-end iron (16) and suitable for interfering with said tenon (18), an adjustment pin (26) carrying on its stem-shaped portion (27) a plurality of ring-shaped springs (28), as well as a rear axial binding (30), an elastic adjustment device of a fore-end iron-action body hold (20) being suitable for giving a suitable hold and/or the recovery of the loss of hold due to the wear of the fore-end iron-action body coupling, said device further characterized in that said adjustment pin (26) comprises a threaded shank (29) for the engagement with said rear axial binding (30) and a collar (31), or abutment plane of said springs (28), as well as elements (32) for the adjustment of the preload of said springs (28).

2. Device according to claim 1, characterized in that said rear axial binding (30) is a cylindrical element, possessing a central cylindrical portion and a flared end portion, said flared end portion having a larger diameter than the central cylindrical portion, said rear axial binding (30) is suitable for being arranged in a seat (33) of a shape matching said fore-end iron (16) and carrying a threaded axial hole (34) suitable for receiving said threaded shank (29).

3. Device according to claim 1, characterized in that said cursor (21) comprises guides (22) made on opposite side surfaces for the sliding axial binding with said fore-end iron (16).

4. Device according to claim 1, characterized in that said cursor (2l) comprises an inclined plane (24) fore the forced contact with said tenon (18).

5. Device according to claim 1, characterized in that it is inserted in an opening or window (23) of said fore-end iron (16).

6. Device according to claim 1, characterized in that said cursor (21) comprises a seat (25) suitable for receiving an end portion of said stem (27) of the adjustment pin (26).

7. Device according to claim 5, characterized in that said plurality of springs (28) abuts on a plane of said cursor (21), said seat making a mechanical stop for said stem (27) suitable for preventing the biasing of said springs (28) in a pack.

* * * * *